US006119732A

United States Patent [19]

Lindblom

[11] Patent Number: 6,119,732

[45] Date of Patent: Sep. 19, 2000

[54] WARP THREAD CONSUMPTION OPTIMIZATION APPARATUS FOR A WEAVING MACHINE

[75] Inventor: Bo Lindblom, Osby, Sweden

[73] Assignee: Texo AB, Almhult, Sweden

[21] Appl. No.: 09/233,485

[22] Filed: Jan. 20, 1999

[30] Foreign Application Priority Data

Feb. 5, 1998 [SE] Sweden ..... 9800332

[51] Int. Cl.[7] ..... D03D 49/06; D03D 49/16

[52] U.S. Cl. ..... 139/97; 139/100; 139/101

[58] Field of Search ..... 139/97, 100, 101

[56] References Cited

U.S. PATENT DOCUMENTS

| | | | |
|---|---|---|---|
| 5,261,465 | 11/1993 | Dore | 139/103 |
| 5,341,851 | 8/1994 | Berktold et al. | 139/103 |
| 5,381,835 | 1/1995 | Norlin | 139/97 |
| 5,421,372 | 6/1995 | Hsu | 139/35 |
| 5,461,881 | 10/1995 | Handel et al. | 139/100 |

FOREIGN PATENT DOCUMENTS

| | | |
|---|---|---|
| 0 624 675 A1 | of 1994 | European Pat. Off. . |
| 440 516 | of 1985 | Sweden . |
| 9202955 | of 1993 | Sweden . |

*Primary Examiner*—Andy Falik

*Attorney, Agent, or Firm*—Pollock, Vande Sande & Amernick, R.L.L.P.

[57] ABSTRACT

A weaving machine comprises an arrangement for adjusting or optimizing the consumption of warp thread. The weaving machine permits weaving of different widths for the woven material. First bobbins can be arranged next to one another, with synchronized rotation, on a warp beam (Vb) of the weaving machine in order to effect a warp thread supply which represents a minimum width for the woven material. Second bobbins can be arranged, individually from the point of view of rotation, in bobbin boards in order to effect a warp thread supply which represents widths between the minimum width and a maximum width for the woven material. The second bobbins are provided with, or can cooperate with, activatable and deactivatable brake members by which the number of second bobbins (2') corresponding to the set weaving width can be engaged for warp thread supply in the weaving machine.

11 Claims, 4 Drawing Sheets

WARP THREAD CONSUMPTION OPTIMIZATION APPARATUS FOR A WEAVING MACHINE

TECHNICAL FIELD

The present invention relates to an arrangement which reduces the consumption of warp thread in a weaving machine designed to weave material with different adjustable widths, which can be considerable and, for example, have values of between 5 and 30 meters. The weaving machine is of the type which comprises or is connected to a load cell designed to detect the warp tension in the weaving machine and, as a function of the detection, to send a value, corresponding to the respective warp tension, to a computer system or a data control unit, a so-called PLC system. The system is in turn designed to determine a first control value for a servo valve which, based on the control value, acts on brake members of at least one warp beam of the weaving machine, which warp beam carries the number of first bobbins with warp threads.

The invention also relates in general terms to a weaving machine of the type which permits weaving of large widths for the woven material and is adjustable for weaving the material in different widths, the warp threads being arranged on bobbins from which they can be reeled off during weaving.

BACKGROUND OF THE INVENTION

In connection with weaving machines having adjustable weaving widths, it is already known to provide for warp-saving measures, by which the consumption of warp thread is to be optimized to the weaving material width so that large amounts of warp do not have to be discarded. Reference may be made here to U.S. Pat. No. 5,381,835 filed by the same proprietor. This patent proposes an arrangement in which bobbins can be placed in bobbin boards and mounted individually, and only the number of bobbins corresponding to the set weaving width are engaged to participate in the weaving, while the remaining bobbins are disengaged.

In weaving machines of this type, for example weaving machines with the names TEXO 300 and TEXO 400, which are sold on the open market, there is a need to provide relatively simple, yet effective arrangements for reducing or optimizing the warp thread consumption. The invention aims to solve this problem among others.

It is important in this connection that known components and equipment can be used in conjunction with the weaving machine for the purpose of creating the novel arrangement. Thus, for example, conventional load cells, servo valves, pneumatic systems, etc., are to be used. The invention solves this problem too.

In such warp-saving measures it is important that already existing and installed weaving machines can be provided with the new facility in a technically simple but effective way. The invention also solves this problem and proposes solutions in which the existing parts and functions of the weaving machine can be retained despite the introduction of the new function. Both in new constructions and modifications, it is important that, for example, all or parts of the warp beams can be included in or constitute part of the function.

In an arrangement for reducing the consumption of warp thread, according to the invention control value for said warp beam constitutes a basis for determining control values for a number of second bobbins which are placed, individually from the point of view of rotation, in bobbin board. With these control values the number of second bobbins can be chosen for effecting warp thread supply at the respectively set material width.

The arrangement is also characterized by the fact that the computer system in the weaving machine calculates the diameter of the warp beam, indicating the starting diameter of each new first bobbin and the number of turns. In addition, each individually mounted second bobbin can be detected by inductive sensors which are designed to count down the turns for the purpose of establishing the respective current diameter of each second bobbin. For each individually mounted second bobbin, the diameter can be calculated in the same way as the diameter of the warp beam. A value which represents the current diameter of each second individually mounted second bobbin is divided by a value for the warp beam diameter and is multiplied by the relevant control value for the warp beam. The control value for the warp beam includes or is combined with a value for the gearing factor based on the fact that the individually rotatable second bobbins have different brake members. In a further preferred embodiment, an air servo valve receives the control value or a control value that can be related to it, and, as a function of the latter, controls a first valve member assigned to an appropriate second bobbin. The first valve member then opens. The first valve member closes when the new pressure in question has been set. A subsequent second valve member can thereafter be controlled in a corresponding manner, etc., until all the second bobbins are set via their associated valve members, after which the whole procedure is repeated again. The time for setting each second bobbin can be, for example, 500 ms. Each second bobbin can be provided with two brake members in the form of brake bands. In the case where there are two or more warp beams, the second bobbins can contain warp threads corresponding to the number of warp beams.

An arrangement for adjusting the warp thread consumption in a weaving machine is essentially characterized by the fact that first bobbins are arranged next to one another, with synchronized rotation, on a warp beam of the weaving machine in order to effect a warp thread supply which represents a minimum width for the woven material. Second bobbins can be arranged, individually from the point of view of rotation, in bobbin boards in order to effect a warp thread supply which represents widths between said minimum width the a maximum width for the woven material. The second bobbins are provided with, or can cooperate with, activatable and deactivatable brake members by means of which the number of second bobbins corresponding to the set weaving width can be engaged for warp thread supply.

By means of the invention, the advantage obtained is that only those bobbins which need to be used are employed in the weaving. For example, if a weaving machine can execute weaving widths of 10 meters, and a cloth of, for example, 8 meters in width is to be woven, it has hitherto been necessary to discard 2 meters of the width of the cloth. With the new warp-saving system, 2 meters of the warp will remain stationary, which means a saving of 25% of the warp. In the case where a cloth of 7 meters in width is to be woven, the saving will be 43% of the warp.

According to the inventive concept, the main warp beam has at least a length corresponding to the narrowest cloth width to be run. If there are two main warp beams, for example so that the warp will be longer between the changes, the loose bobbins will contain twice the number of threads. The novel proposal means, among other things, that warp-saving can be introduced in a more economical way than before.

BRIEF DESCRIPTION OF THE DRAWING(S)

A presently proposed embodiment of an arrangement having the features particular to the invention will be described below with reference to the attached drawings, in which FIG. 1 is a horizontal view and outline diagram of a warp beam arrangement with associated first bobbins attached thereon, FIG. 2 is a horizontal view and outline diagram of the warp beam arrangement according to FIG. 1 has been fitted with second bobbins placed in bobbin boards, the control circuits for first brake members for the warp beam having been integrated with control members for second brake members for the second bobbins, FIG. 3 shows a side view of the arrangement according to FIG. 2, and FIG. 4 represents a partial view, turned through 90°, of the arrangement for a second bobbin.

DETAILED DESCRIPTION OF THE PREFERRED EMBODIMENT(S)

Figure 1:
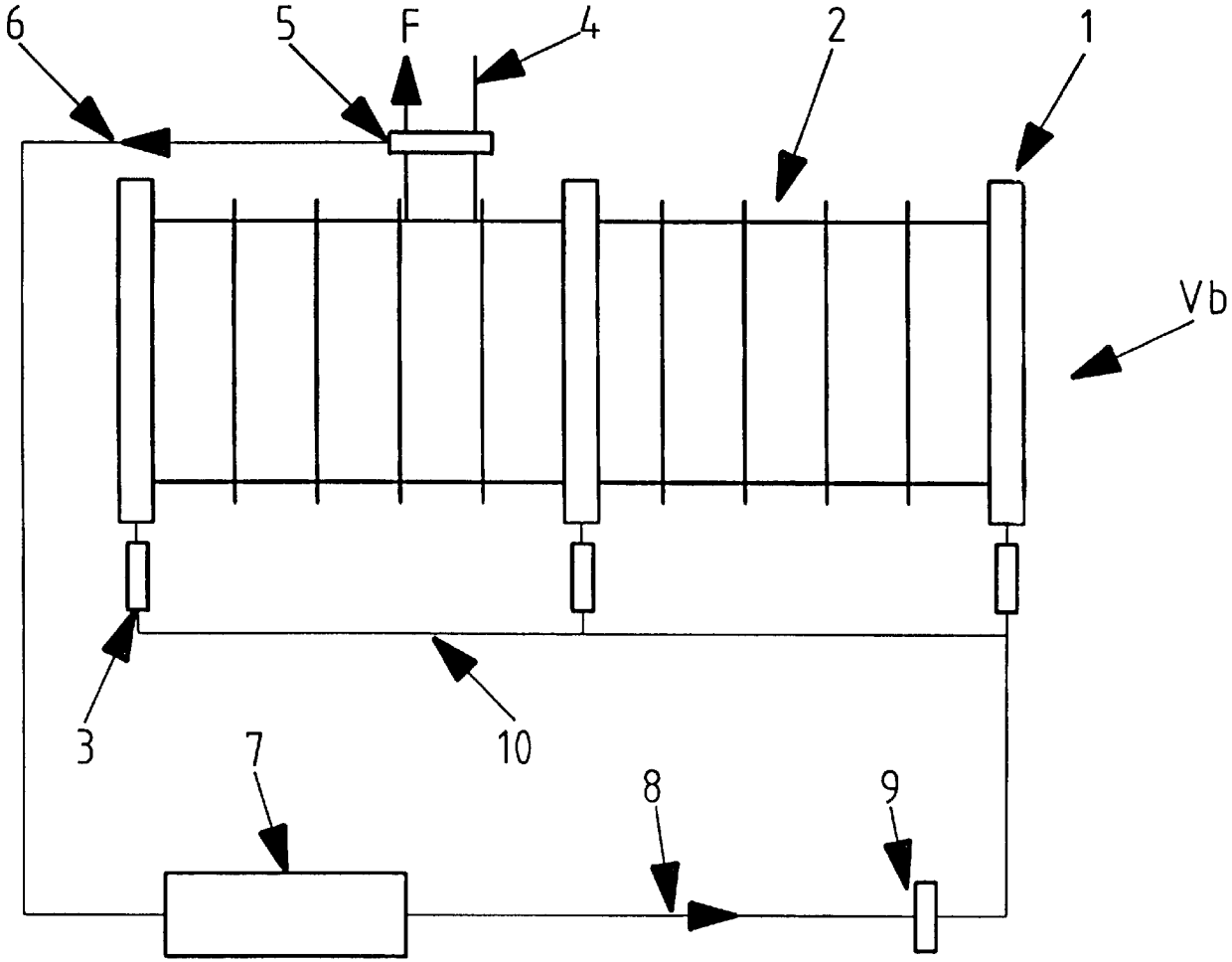

In FIG. 1, a warp beam in a weaving machine of the type is indicated symbolically by Vb. The appearance, position and function of the warp beam are well known and will not therefore be detailed here. A number of first bobbins 2 are placed on the warp beam. They are positioned using a longitudinal wedge (not shown) which has the task of fixing the angle of rotation of the first bobbins 2 in relation to the warp beam so that the first bobbins rotate in synchronization as the warp is fed out. This function is also very well known and will not therefore be described in detail here. The warp beam is provided with a number of brake members, in this case in the form of brake bands 1. Here, three brake bands are arranged on the warp beam, two of the brake bands being placed at the ends of the warp beam and one brake band being placed in the central parts of the warp beam. As the warp beam rotates, in conjunction with the weaving in the actual weaving machine, warp threads are fed out; warp threads 4 from only one of the first bobbins have been shown. The tension of the warp threads, the tensile stress F, can be detected by a load cell 5 of a known type and in a known manner. Depending on the warp tension detected, the load cell generates a signal 6 which represents a control signal (actual value) for a computer unit 7 (PLC unit) belonging to the weaving machine. Depending on the signal received, the unit 7 generates a control signal 8 for an air servo valve 9. The air servo valve too can be of a known type and will not therefore be described in detail here, and it will simply be noted that the valve connects an air source to one or more air hoses (lines) which lead to air cylinders 3 arranged on each brake band 1. Thus, one air cylinder serves one brake band, which means that there are three air cylinders in the present case.

Figure 2:
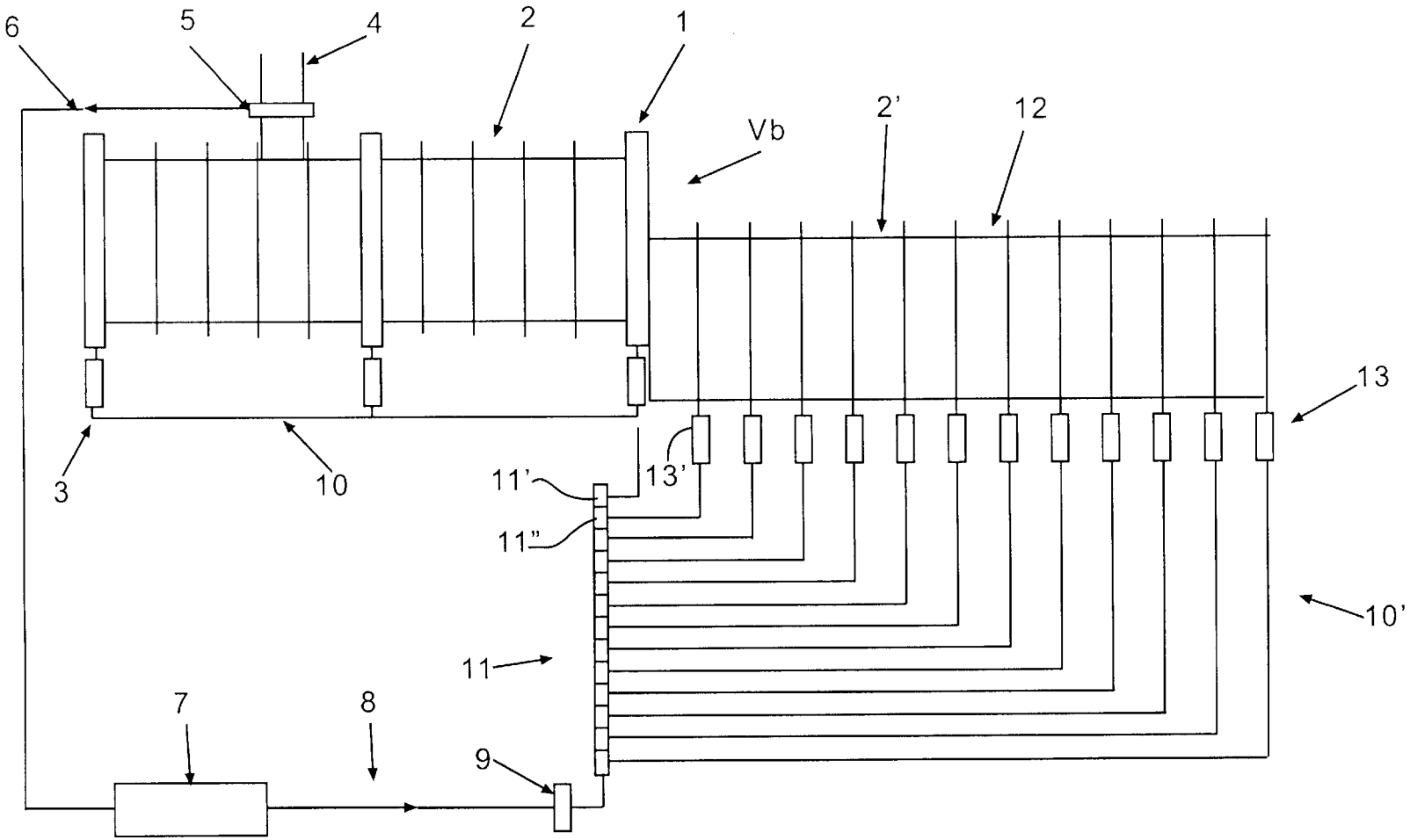
Figure 3:
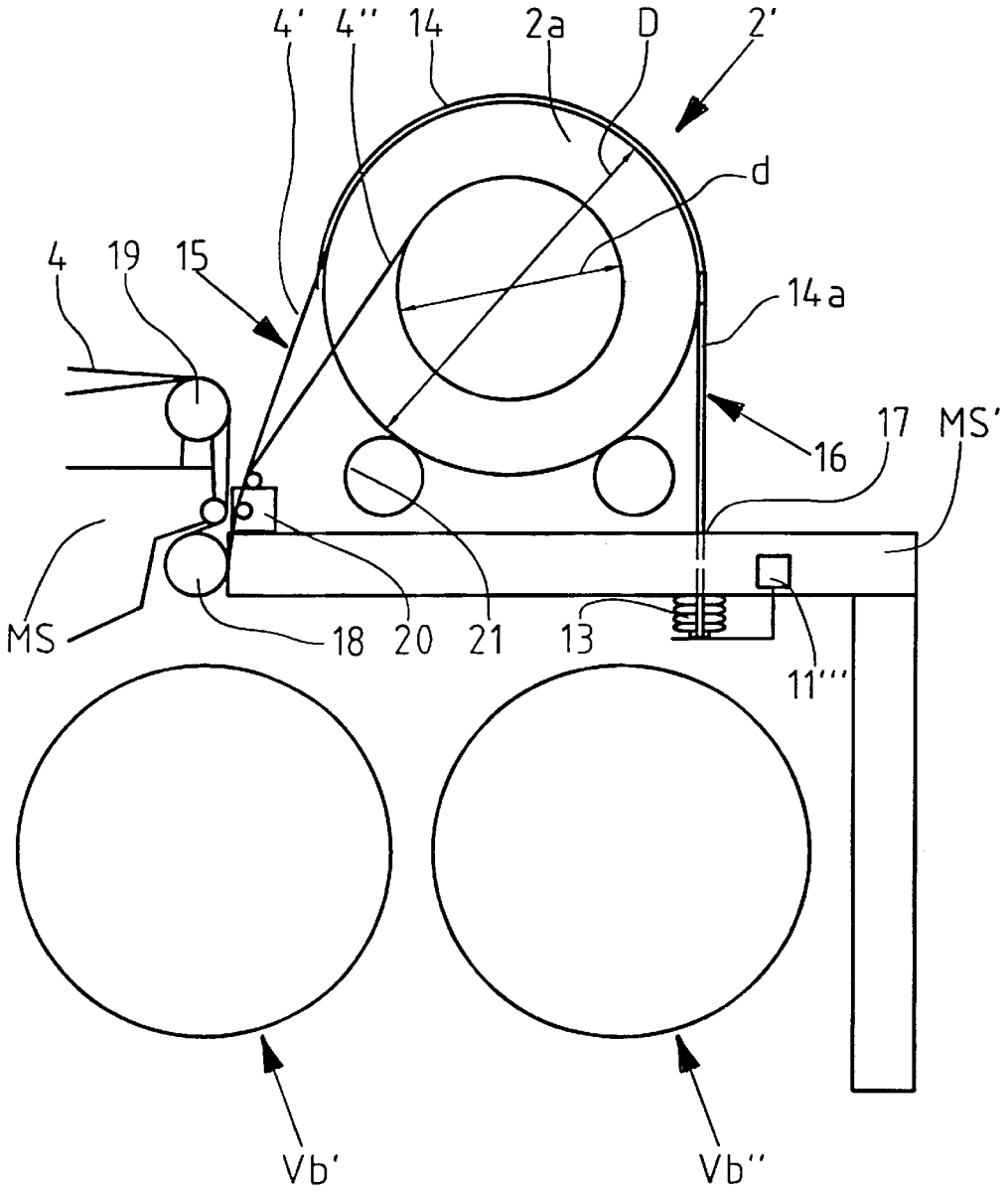

In FIG. 1, the equipment according to FIG. 3 has been fitted with a number (in this case 12) of second bobbins 2' which are positioned in a known manner in bobbin boards (not shown). Reference may be made in this connection to the bobbin boards in the above mentioned U.S. specification. Each second bobbin is allocated two brake bands, one on each end face. In the case according to FIG. 2, the output of the air servo valve is connected to second valve members 11. Both the air hose system according to FIG. 1 and an air hose system 10' are connected to the output of the second valve members. Each second bobbin is allocated an air cylinder 13 which corresponds to the air cylinder 3 in FIG. 1. In the system according to FIG. 2, the air cylinders for the main warp beam are engaged by a valve member 11', a first air cylinder 13 by a second valve member 11", etc.

FIG. 3 shows that two main warp beams Vb' and Vb" can be included in the system. FIG. 3 also shows a second bobbin 2'. In FIG. 3 too, the warp thread is represented by 4. The second bobbins are arranged on a machine stand Ms of a known type. A brake band 14 is shown and is applied round one end face 2*a* of the second bobbin. The brake band 14 is secured at one end 15 to the machine stand Ms in a known manner. The brake mechanism is arranged at the second end of the brake band at which a rod 14*a* extends down into a recess 17 to the underside of a crossmember Ns' where an air cylinder 13', for example in the form of a rubber bladder, is arranged. The rod 14*a* is in this case secured to the rubber bladder 13' and the rubber bladder is arranged in the machine stand part Ms' so that on delivery of a quantity of air into the bladder its volume is increased and the brake band 14 is tightened around the end face so that the rotation of the second bobbin is prevented. Conversely, when the rubber bladder is emptied of air, the grip of the brake band on the end face 2*a* is loosened, with the result that the second bobbin can corotate in the warp thread delivery. The warp thread is guided around rollers 18 and 19. The outgoing warp thread part 4', 4" assumes different angles depending on the degree of delivery. The part 4' represents the angle on delivery from a full second bobbin, while the part 4" represents the delivery from a reduced diameter. The diameter of the fully charged bobbin is indicated by D, and the reduced diameter is indicated by d. The outgoing part 4', 4" is passed over a load cell 20 for measuring the warp tension. In FIG. 2, the valve members are represented by 11'". Each second bobbin is arranged on inductive sensors 21.

Figure 4:
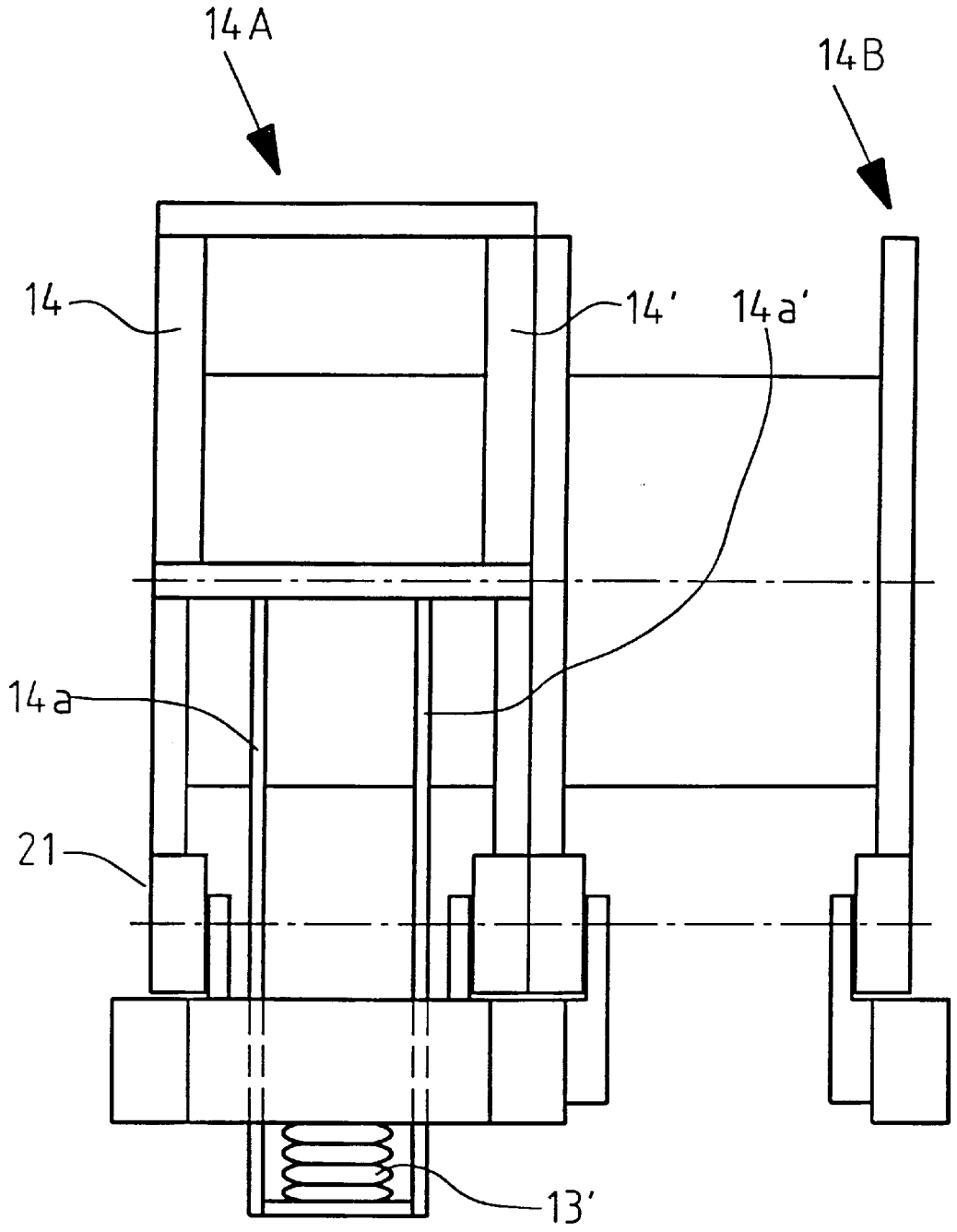

In FIG. 4, two bobbins are shown placed alongside each other. It will be seen here that each second bobbin has two brake bands 14, 14' and two rods 14*a*, 14*a*'. A first bobbin is indicated by 14A and a second bobbin is indicated by 14B. The shapes and positions of the second bobbins are assumed to be known and will not be described in detail here.

The system according to FIGS. 2, 3 and 4 is made up in such a way that the load cell 5 reads the warp tension into the computer unit or the PLC system which calculates the control value 8 for the air servo valve 9. The air servo valve controls the air pressure to the air cylinders 3 which are coupled to the brake bands 1 on the main warp beam. The control value for the main warp beam is used to calculate the control value of each second bobbin. The diameter of the main warp beam is calculated by means of the starting diameter and number of turns being indicated for a new second bobbin. The inductive sensors 21 (two in the case shown here) are used to count down the turns of each second bobbin and in this way the actual diameter D, d can be established. For each second loose bobbin, the diameter is calculated in the same way as for the main warp beam. The diameter of each second bobbin is divided by the main diameter and multiplied by the control value for the main warp beam. Since the loose bobbins do not have the same brake, a gearing factor must be included. When this value is calculated, the control value 8 is sent to the air servo valve 9, and the valve member 11 for the appropriate bobbin is opened. When the new pressure is set, the valve member in question is closed and the next value is transmitted via the next valve member, etc. This procedure is repeated until all the loose bobbins have been set, after which the process starts again on the new bobbin. Each bobbin takes 500 ms to set.

Each loose second bobbin has two brake bands according to the above and an air cylinder 13 and a valve member 11.

Each second bobbin is mounted on four mounted rollers (see above mentioned U.S. patent specification) The main warp beam Vb functions as usual on the bit of warp always being used. The rest of the length which is related to the warp saving on the main warp beam is without bobbins. Since the control pressure of the main warp beam is calculated with the aid of the diameter difference of the loose bobbins, the warp tension will always be the same between the first bobbins on the warp beam or the warp beam and the loose second bobbins. The PLC unit calculates each new pressure and the air servo valve 9 sets this pressure. When the air servo valve has reached this pressure, the appropriate valve member 11 is opened and the new pressure is introduced into the air cylinder (or rubber bladder). The valve is then closed and the air servo valve adjusts itself for the next bobbin. In this way the brake members/brake bands can be activated as a function of controls from the PLC unit and for the set material width (cloth width) in question can engage only the number of second bobbins corresponding to the set width.

The invention is not limited to the embodiment presented by way of example above, and instead modifications can be made thereto within the scope of the attached patent claims and the inventive concept.

For example, the brake devices allotted the second bobbins may be set so they brake respective second bobbins differently in dependence of the remaining amount of warp thread on respective second bobbin. A larger amount of remaining warp thread needs less braking force executed by the brake device of the second bobbin, and vice versa. This because a larger amount of warp threads effects a larger counter force than the less amount of warp thread, and vice versa. The setting of the braking forces of the first and second bobbins is effected continuously or at certain time periods during the ongoing weaving procedure of the weaving machine. The expression "diameter" used above in connection with respective first and second bobbin refers to the diameter of the remaining amount of warp thread.

What is claimed is:

1. Weaving machine arrangement which reduces consumption of warp thread, comprising:

a warp beam;

first bobbins arranged on the warp beam, the warp threads being fed out of the first bobbins;

a load cell arranged to detect tension in the warp threads and to send a signal corresponding to the tension to a computer system, the computer system determining a control value based on the signal;

first brake members acting on the warp beam;

a servo valve receiving the control value from the computer system and controlling the brake members based on the control value;

second bobbins arranged to rotate individually in bobbin boards; and second brake members controlling rotation of the second bobbins, the second brake members being controlled to determine the number of second bobbins which rotate based on the control value.

2. An arrangement according to claim 1, further comprising inductive sensors for detecting each individually mounted second bobbin and wherein the inductive sensors count down the turns for the purpose of establishing a respective current diameter.

3. An arrangement according to claim 1, wherein each second bobbin is controlled by two brake members in the form of brake bands.

4. A method for reduction of consumption of warp thread in a weaving machine, comprising a warp beam, first bobbins arranged on the warp beam, and second bobbins arranged in bobbin boards, said method comprising the steps of:

feeding the warp threads out of the first bobbins;

arranging a load cell for detecting tension in the warp threads and for sending a signal corresponding to the tension to a computer system;

determining in the computer system a control value based on the signal;

acting on the warp beam with first brake members;

sending the control value from the computer system to a servo valve and controlling the brake members based on the control value;

arranging second bobbins to rotate individually in the bobbin boards; and controlling rotation of the second bobbins with second brake members, the second brake members being controlled to determine the number of second bobbins which rotate based on the control value.

5. A method according to claim 4, further comprising providing the computer system with means for calculating a diameter of the warp beam, and selecting a starting diameter of each new first bobbin and a number of turns.

6. A method according to claim 5, further comprising providing inductive sensors for detecting each individually mounted second bobbin and counting down with the inductive sensors the turns for the purpose of establishing a respective current diameter.

7. A method according to claim 6, comprising dividing a value which represents the current diameter of each individually mounted second bobbin by a value for the warp beam diameter and multiplying by said control value for the warp beam.

8. A method according to claim 7, including adapting a time for setting each second bobbin for about 500 ms.

9. A method according to claim 6, further comprising controlling each second bobbin by two brake members in the form of brake bands.

10. A method according to claim 9, wherein in the case where there are two warp beams (Vb', Vb") the method further comprises providing the second bobbins with twice the number of warp threads.

11. An arrangement for adjusting the consumption of warp thread in a weaving machine, the weaving machine being adapted for weaving large widths and being adjustable for weaving material in different widths, and also including the warp threads arranged on bobbins from which they can be reeled off during weaving, the arrangement comprising first bobbins arranged next to one another, with synchronized rotation, on a warp beam of a weaving machine for feeding a warp thread supply which represents a minimum width for the woven material, and second bobbins arranged, for individually in bobbin boards, to effect a warp thread supply which represents widths between said minimum width and a maximum width for the woven material, the second bobbins being adapted to cooperate with activatable and deactivatable brake members by means of which the number of second bobbins corresponding to the set weaving width can be engaged for warp thread supply, and wherein the brake members are activatable and deactivatable by means of servo valves that sense tension of the warp threads.

* * * * *